United States Patent [19]

Caferro

[11] Patent Number: 4,753,219

[45] Date of Patent: Jun. 28, 1988

[54] REFLECTIVE HEAT CONDUCTOR

[76] Inventor: Dennis Caferro, E. 508 Augusta, Spokane, Wash. 99207

[21] Appl. No.: 89,230

[22] Filed: Aug. 25, 1987

[51] Int. Cl.[4] ..... F23J 3/00

[52] U.S. Cl. ..... 126/307 R; 165/904; 237/55; 126/92 B

[58] Field of Search ..... 126/92 B, 92 C, 91 R, 126/92 AC, 92 R, 201, 118, 80, 307 R; 165/901, 904, 136, 133; 237/55, 51

[56] References Cited

U.S. PATENT DOCUMENTS

| | | | |
|---|---|---|---|
| 533,498 | 2/1895 | Rowell | 404/134 |
| 1,631,721 | 6/1927 | DeBoischevalier | 165/76 |
| 2,161,417 | 6/1939 | Holmes | 122/13 |
| 3,389,451 | 6/1968 | Speca et al. | 29/160 |
| 4,232,732 | 11/1980 | Johnson | 165/77 |
| 4,235,286 | 11/1980 | Behlau | 165/164 |
| 4,313,562 | 2/1982 | White | 237/55 |
| 4,359,187 | 11/1982 | Moore | 237/55 |
| 4,448,348 | 5/1984 | Bidwell | 237/55 |
| 4,467,959 | 8/1984 | Laviguer | 237/55 |
| 4,527,538 | 7/1985 | Caferro | 126/21 R |

FOREIGN PATENT DOCUMENTS

| | | | |
|---|---|---|---|
| 115481 | 7/1942 | Australia | 165/904 |
| 3530927 | 3/1986 | Fed. Rep. of Germany | 126/92 B |
| 387828 | 2/1933 | United Kingdom | 165/904 |

OTHER PUBLICATIONS

*Woodstove Directory*, 1979, p. 154.

*Primary Examiner*—James C. Young
*Attorney, Agent, or Firm*—Wells, St. John & Roberts

[57] ABSTRACT

A reflective heat conductor is presented in the form of a grill having a plurality of individual cells bounded by reflective bare metal surfaces. The grill has an arcuate shape complementary to the object, such as a stovepipe, on which it is located. Heat transfer is effected by substantially increasing the conductive area of the surface of the object on which it is mounted, by reflecting radiant heat energy emitted by the surface, and, in the case of a stovepipe, by also increasing turbulence within the stovepipe to reduce stack velocity and produce more complete burning.

4 Claims, 3 Drawing Sheets

10
24
12
11
16
24
16
12
24

REFLECTIVE HEAT CONDUCTOR

TECHNICAL FIELD

This invention relates to a reflective heat conductor for extracting heat from articles such as a stovepipe.

BACKGROUND OF THE INVENTION

Heat exchangers, or heat extractors, are typically mounted on heat generating or heat transporting articles, such as a section of stovepipe or are inserted into the article. When used in conjunction with a stovepipe, they attempt to improve energy efficiency of a stove or fireplace system by increasing the distribution of heat to the surrounding room area. A typical exchanger for such applications utilizes transverse pipes arranged across an enclosed box that is inserted in the length of stovepipe so that flue gases enter the box and flow about the exterior of the pipes. Room air is blown through the pipes for heat exchange purposes (a variation of this form of heat exchanger is shown in U.S. Pat. No. 4,235,286). An alternative is the use of multiple smoke tubes in place of the single stovepipe in one section above a stove (see U.S. Pat. No. 4,232,732). Blowers are also arranged between concentric cylinders about the exterior of a stovepipe to improve convection (see U.S. Pat. Nos. 1,631,721, 4,448,348 and 4,467,959). Heat exchangers have been criticized because of a common tendency to increase creosote accumulation in the stove system, which is due to their common property of cooling at least a portion of the stovepipe.

The general concept of attaching an exposed finned heat exchanger to the exterior of a water heater is shown in U.S. Pat. No. 2,161,417. A similar type of stovepipe heat exchanger that requires no modification of the stovepipe itself and involves the addition of exposed radiating fins mounted about the cylindrical stovepipe surfaces has been marketed for use with stoves. This prodict known as CHIMFIN (TM) radiators, has been manufactured by the Condar Company of Garrettsville, Ohio, and was shown in the *Woodstove Fireplace and Equipment Directory* (1979) at page 154. Both fin structures utilize relatively large metallic surfaces in direct contact with the heated cylindrical surfaces on which they are mounted. This covering structure substantially impedes normal radiation of heat from the covered areas and reduces overall efficiency. In addition, the CHIMFIN product is stated to be produced from aluminum having black fin surfaces that "emit maximum radiant heat." Since the fin surfaces are emissive, they also will absorb most radiation directed to these surfaces. This absorptive quality limits the transmission of heat to the surrounding atmosphere.

The present invention seeks to maintain most of the normal heat radiating capability available in an article such as a conventional stovepipe, while adding substantially to its conductive area and imparting novel reflective properties to dissipate radiant heat energy to the surrounding atmosphere. This has been done effectively without the use of forced air techniques--in fact, forcing air about the described heat exchanger has been found to destroy its effectiveness.

The present invention provides a nonintrusive heat exchanger that can be readily mounted about any cylindrical heated object or article. It requires no modification of the item with which it is used. It uniquely combines heat conduction and surface reflective qualities to substantially add to the quality of heat available for convection by normal room air currents.

BRIEF DESCRIPTION OF THE DRAWINGS

The preferred embodiment of the invention is illustrated in the accompanying drawings, in which.

DETAILED DESCRIPTION OF THE PREFERRED EMBODIMENT

Figure 1:
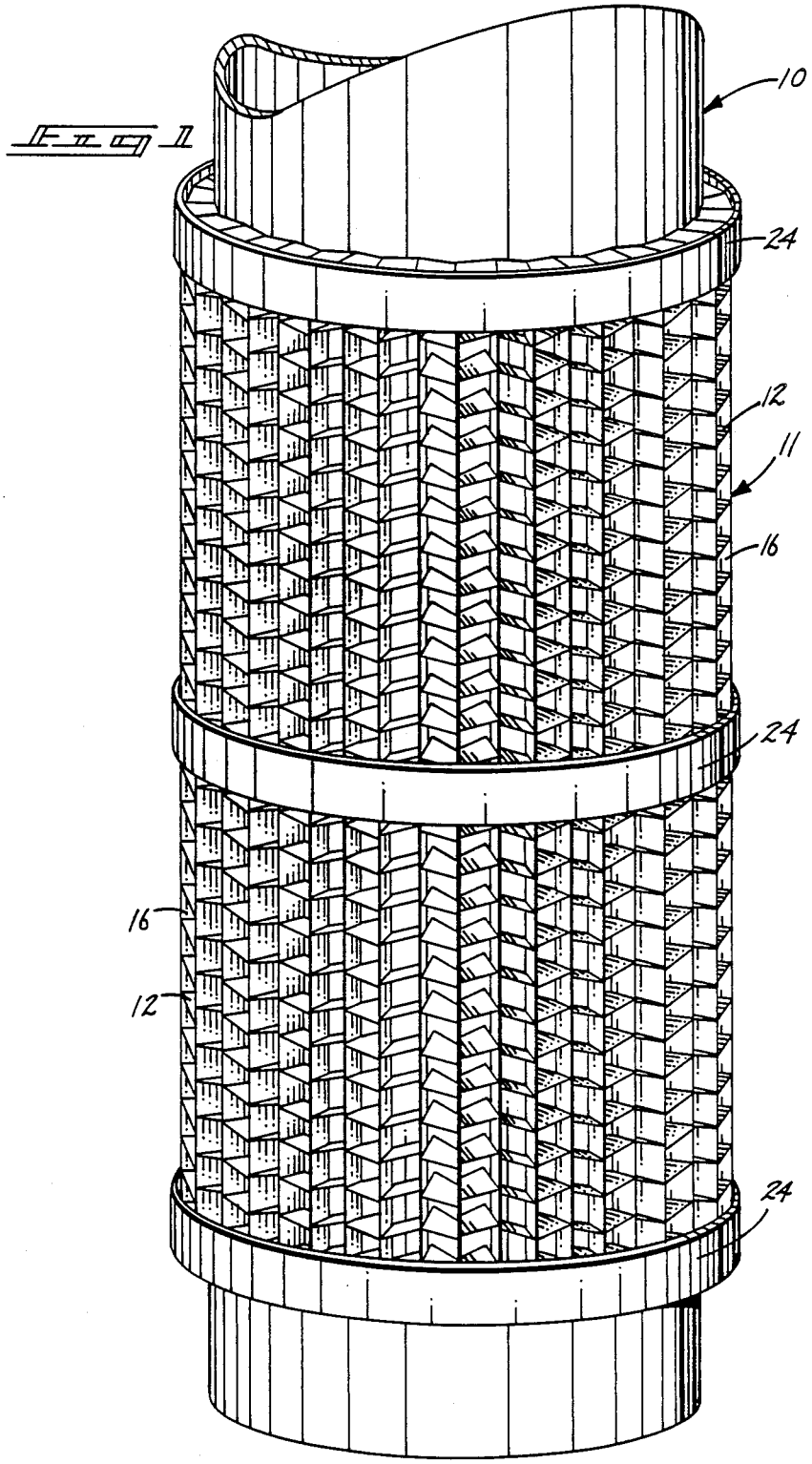
FIG. 1 is a front perspective view of the heat exchanger when mounted on a stovepipe.
Figure 2:
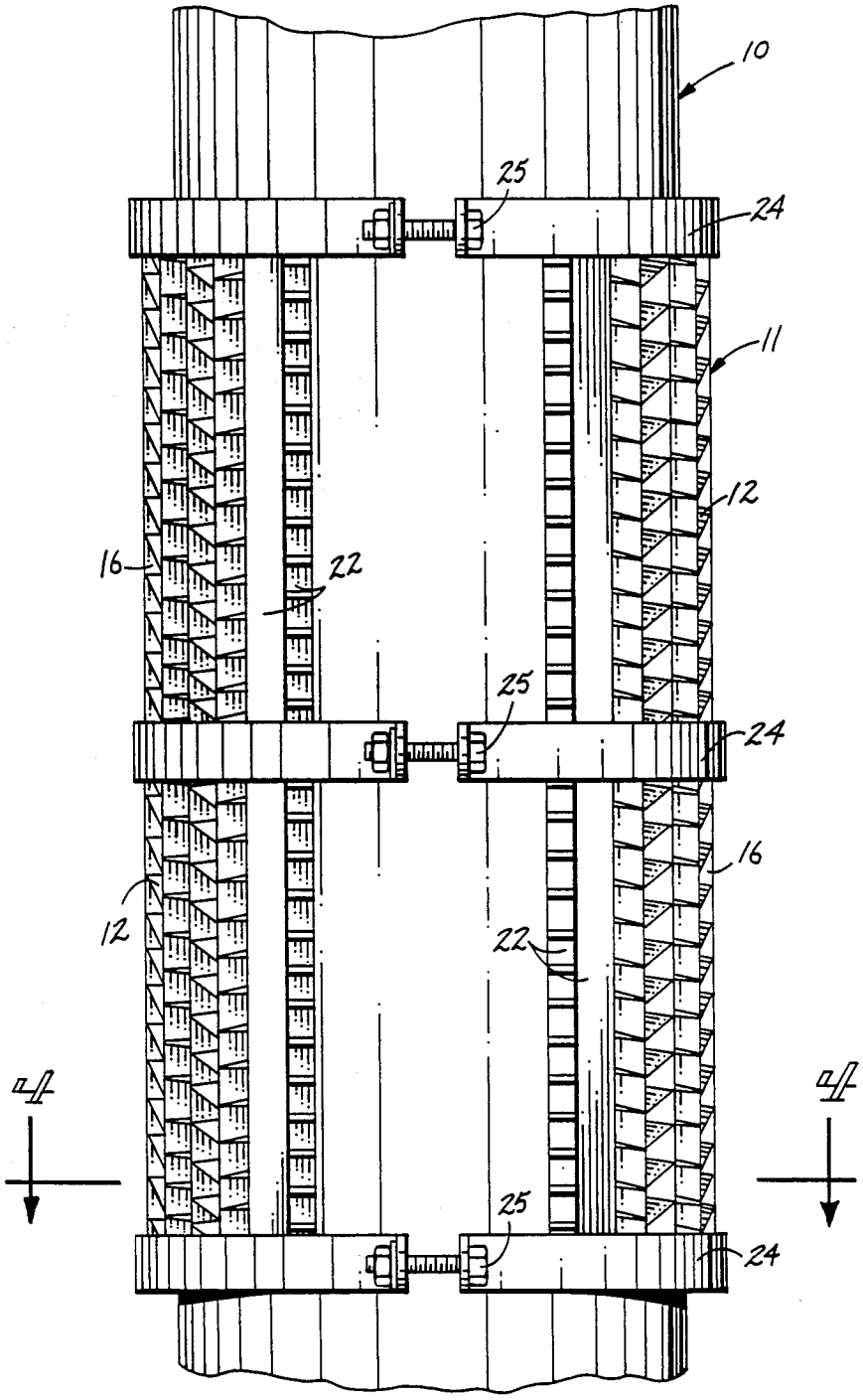
FIG. 2 is a rear elevation view.

The following disclosure of the invention is submitted in compliance with the constitutional purpose of the Patent Laws "to promote the progress of science and useful arts" (Article 1, Section 8).

The original prototype of the present invention was designed for stovepipe applications to facilitate transfer of heat from the stovepipe exterior to the surrounding room area. However, the reflective heat conductor can be adapted to use about any object or article that internally generates heat (such as a stove or electric motor) or transports heat (such as steam or hot water conduits). It can partially or completely encase any arcuate or partially cylindrical wall of such an article, which might have a solid core (motor and generator casings, transformers); liquid core (tube heat exchangers, hot water conduits, hot liquid tanks or vessels); or a gaseous core (flue gas stacks, steam conduits).

For illustrative purposes, the invention will be described in detail as applied specifically to a stovepipe. It will be readily apparent that no substantial modification would be necessary to apply to other objects or articles where a temperature difference exists between the interior of the object or article and the surrounding atmosphere environment.

The drawings illustrate details of the reflective heat conductor, which is adapted for replacement against the exterior of a vertical metallic stovepipe 10. Most stovepipes are dark in color, which maximizes emission of energy from the usual cylindrical surfaces presented by the stovepipe. The radiation of emissive heat energy from a conventional stovepipe adds to the overall efficiency of the room heating system. A building area heated by a stove or fireplace (not shown) typically utilizes the stovepipe as a smoke flue leading to a chimney (not shown).

The present improvement is shown as an arcuate grill 11. Grill 11 is fabricated from a planar metal grid. One form of such grids is widely used in the lighting industry as a diffuser and cover for ceiling lighting installations. Two perpendicular sets of intersecting walls used in each grid are oppositely slotted from their top and bottom surfaces and cold-welded to one another at their intersections as they are pressed oppositely together. Related rectangular grid structures are described in U.S. Pat. No. 533,498 to Rowell, patented Feb. 5, 1895, and in U.S. Pat. No. 3,389,451 to Speca, et al., patented June 25, 1968. These prior patented disclosures are hereby incorporated into this disclosure by reference as illustrations of alternative grid fabricating techniques applicable to this disclosure. It is to be understood that the grid can be produced by many equivalent fabricating methods.

Although the metal grid can be produced from many different materials, aluminum is particularly adaptable to this usage because of its ready availability in rolled sheet form, its ease of fabrication, and its highly reflective surface characteristics. A typical grid as used in the lighting industry is constructed from intersecting strips cut from aluminum can sheet stock at a width of one-half inch. Each cell in the grid is one-half inch square. The strip thickness is 0.025 inches or 0.00064 meters.

Because reflection of radiating heat energy is crucial to the operation of this product, the grid should be fabricated from smooth, bare metal strips. As alternatives to the uncoated aluminum can stock used in lighting grids, one might utilize sheets of other metals, such as copper. It is preferable that the metal strips and fabricated grid be uncoated and that the surface properties of the metal strips be more reflective than emissive. By exhibiting surface characteristics that are predominantly reflective, the strips contribute significantly in transferring radiated heat energy from stovepipe 10 and grill 11 to the surrounding room atmosphere. Surfaces having predominantly emissive characteristics would absorb or "trap" a substantial part of the radiating heat energy being emitted.

To produce the grill 11 as shown in the drawings, the usual planar shape of the rectangular metal grid which is the starting material for production of this product must be bent into a partial cylindrical form extending about a central axis. This has been successfully achieved with respect to grids having one-half inch cells. Conventional bending procedures and machinery have been used.

Grid 11 can be arcuately extended about any desired portion of the stovepipe 10 on which it is to be mounted. If a complete circumferential covering is desired, this can be accomplished with a unitary grill or by making the grill in two or more arcuate sections arranged about the circumference of the stovepipe 10. In the preferred embodiment illustrated in the drawings, the grill extends over more than 180 degrees of the circumference about stovepipe 10 and can be easily flexed to receive the stovepipe 10 without risking damage to the arcuately-bent grill structure.

The open vertical edges of the grill are covered by angular reinforcement members 22. The grill 11 is mounted to the stovepipe 10 by three circumferential metal bands 24 clamped in place by releasable bolts 25. The upper and lower bands 24 slighty overlap the upper and lower edges of the grill to present a clean outer appearance to the mounted device. The members 22 and bands 24 are preferably made from uncoated metal matching the material used in production of grill 11.

Figure 3:
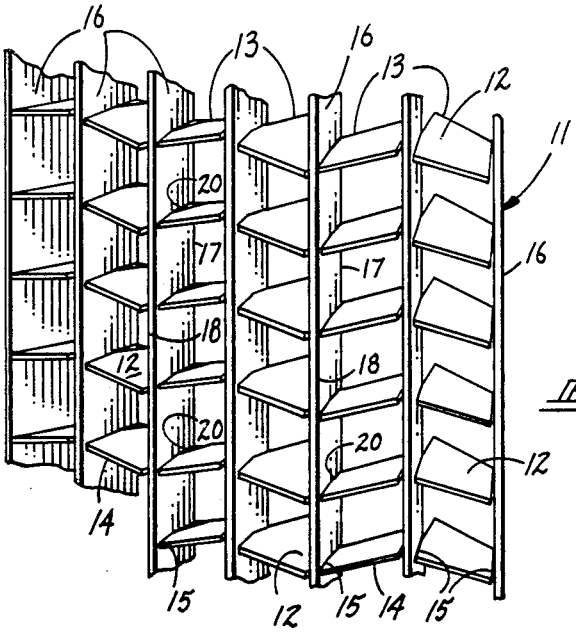
FIG. 3 is an enlarged perspective view of one area in the heat exchanger grill.

Referring more specifically to FIG. 3, the horizontal strips 12 in grill 11 have continuous inner arcuate edges 13 arranged in a cylindrical configuration complementary to the exterior surface of stovepipe 10. They also have radially outer edges 14 interrupted by a plurality of circumferentially spaced radial slots 15 that extend inwardly across a portion of each strip. Similarly, vertical strips 16 have continuous straight inner and outer edges 17, 18 that are substantially flush with respect to inner and outer edges 13, 14 of the horizontal strips 12. The inner edges 17 of the vertical strips 16 are interrupted along their length by a plurality of spaced perpendicular slots 20 that extend inwardly in opposition to the radial slots 15 of the horizontal slots. The interesting horizontal and vertical strips 12, 16 are interfitted by the respective slots 15, 20 formed in them to present a continuous arcuate pattern of substantially rectangular cells.

Figure 4:
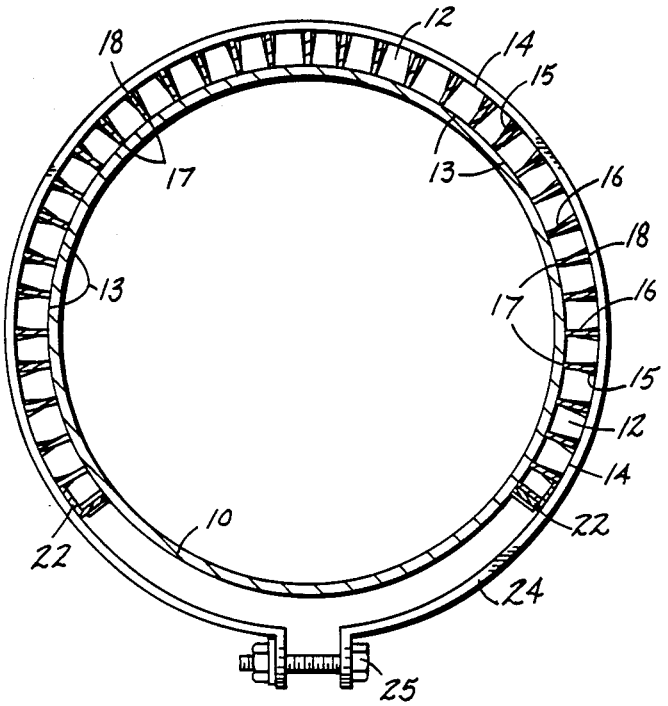
FIG. 4 is a transverse section taken along line 4—4 in FIG. 2.

Since the continuous metal edges of the horizontal strips 12 are bent arcuately, they assume a wave-like elevational form during the cylindrical bending process, and a substantially arcuate edge configuration when viewed in a horizontal plane (see FIG. 4). This results in substantial edge contact between the strips 12, 16 when engaged about the periphery of a stovepipe 10. However, it is to be noted that the engagement of strips 12, 16 occurs only along their exposed inner edges 13, 17, and requires no substantial overlapping surface area about stovepipe 10, as has been the case in earlier radiating fin devices propopsed as heat exchangers. In the case of the one-half inch by one-half inch metal grids previously described, the actual surface area of stovepipe 10 physically covered by the edges of the metal fins is less than five percent of the total area under the grill 11. This minimizes the usual detrimental effect of covering a portion of the radiating stovepipe surface.

In contrast to the substantially cylindrical curvature of the inner edges 13, 17, the outer edges 14, 18 of the metal strips 12, 16 assume a multisided or polygonal configuration when viewed in a horizontal plane. This is due to the expansion possible across the open radial slots 15 in the curved horizontal strips 12, which accommodate the required peripheral expansion about the bent grill structure without unduly stretching or damaging the rather thin metal walls of the starting rectangular grid. The fact that the intersections between strips are bonded only at the bases of their respective slots provides dimensional adjustment during bending to accommodate a change of curvature in the grill. The planar grid can therefore be bent by conventional methods without losing the desired visual uniformity of the multiple cells formed by the intersecting strips. The outward appearance of the cells has a vertical herringbone configuration.

Extensions of the strips 12 and 16 are used to terminate the edges of the grid. As previously described, the reinforcement members 22 are arranged to cover and strengthen the exposed vertical edges of grill 11. Members 22 are held in place by bent terminal ends 21 of the horizontal strips 12. The upper and lower grill edges, which are not reinforced in the preferred embodiment since they must be flexed during placement of the grill about a stovepipe, are simply terminated by folding the terminal ends 23 of the vertical strips 16 to a substantially flush position against the adjacent outer horizontal strips 12.

Grill 10 has been found to improve the heating effectiveness of a stove or fireplace installation in three areas: improved convection, increased thermal radiation, and improved burning. By vastly increasing the surface area available at the stovepipe for transferring heat energy to the surrounding air for convection purposes, this product acts in a manner similar to an automobile radiator to assure high efficiency heat transfer. When utilizing aluminum, which is highly conductive and approximately five times more conductive than the usual steel in a stovepipe, and by increasing the effective stovepipe area by 400% with wall thicknesses less than 1/64 inch, the grill is capable of theoretically transferring at least forty times more heat to the surrounding air than will an equivalent section of stovepipe. Thermal radiation is increased as radiant heat energy reflects off the surfaces of the grill. Because the grill has been found to extract as much as 200° F. from a 21 inch length of stovepipe, the air density above the combustion area in the stove or fireplace increases by as much as 15% and stack velocity is slowed. This produces a more complete burning process in the stove.

While it has been reported that many heat exchanges mounted about a stovepipe result in a reduced stovepipe temperature in the area of the heat exchanger, experimental efforts relating to the grill described above have shown that stovepipe surface temperatures are increased when grill 11 is utilized. This is attributed to the substantial heat conducting properties of the grill and its reflective nature, which permits radiation from the stovepipe surface to be directed into the room without substantial absorption in the grill itself. As heat is transferred through the grill 11, the stream of smoke and flue gases flowing through the stovepipe 10 and delivering this heat energy is subjected to turbulence, which slows air movement and increases transfer of heat to the stovepipe walls. The slower movement of flue gases provides more time for transfer of heat to the stovepipe and surrounding grill. Additional time is therefore allowed for heat to be transferred from the flue gases to the stovepipe 10 and grill 11, and ultimately to the surrounding room air. This is accomplished without choking off the stream of gases by using interior baffles or restrictive convoluted air paths. The higher surface temperatures in stovepipe 10 result in increased thermal radiation and reduced deposits of insulating soot and creosote. The net overall effect of this sequence is that the stove or fireplace requires substantially less fuel to maintain a desired room temperature. The draft in the stovepipe 10 above the grill 11 has been found to be decreased and less excess air is required within the stove. The reflective grill 11 also introduces more turbulent convective currents of warmed air adjacent to the stovepipe 10, in place of the usual laminar convective currents that flow along the smooth cylindrical stovepipe surfaces.

In compliance with the statue, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A reflective heat conductor adapted for placement along a vertical metallic stovepipe within a building area heated by a stove or fireplace utilizing the stovepipe as a smoke flue, comprising:

an arcuate grill including a plurality of intersecting horizontal and vertical strips of smooth bare metal;

the horizontal strips having continuous inner arcuate edges arranged in a cylindrical configuration complementary to the exterior surface of a length of stovepipe and radially spaced outer edges interrupted by circumferentially spaced radial slots extending inwardly across a portion of the strips;

the vertical strips having continuous straight inner and outer edges that are substantially flush with the respective inner and outer edges of the horizontal strips, the inner edges of the vertical strips being interrupted along their length by spaced perpendicular slots extending inwardly in opposition to the radial slots of the horizontal strips;

the intersecting strips being interfitted by the respective slots to form a continuous arcuate pattern of substantially rectangular cells;

and means for securing the grill about a length of stovepipe with the inner edges of the interlocked horizontal and vertical strips engaging the exterior cylindrical surfaces of a stovepipe.

2. The reflective heat conductor of claim 1 wherein the grill is fabricated from aluminum can stock.

3. The reflective heat conductor of claim 1 wherein the grill is formed as a partial cylinder extending more than 180 degrees about a central axis.

4. The reflective heat conductor of claim 1 wherein the fastening means comprises a plurality of separable circumferential bands clamped over the grill.

* * * * *